US008839985B1

(12) United States Patent
Sanchez et al.

(10) Patent No.: US 8,839,985 B1
(45) Date of Patent: Sep. 23, 2014

(54) COFFEE CUP PLUG

(71) Applicant: Pinestreet LLC, Puyallup, WA (US)

(72) Inventors: Neil Kim Sanchez, Puyallup, WA (US); Adrienne Marlane Sanchez, Puyallup, WA (US)

(73) Assignee: Neil Kim Sanchez, Puyallup, WA (US)

( * ) Notice: Subject to any disclaimer, the term of this patent is extended or adjusted under 35 U.S.C. 154(b) by 0 days.

(21) Appl. No.: 13/967,319

(22) Filed: Aug. 14, 2013

(51) Int. Cl.
*B65D 25/00* (2006.01)
*B65D 55/00* (2006.01)

(52) U.S. Cl.
CPC ..... *B65D 55/00* (2013.01)
USPC ..... 220/738; 220/740; 220/801; 220/361; 220/703; 220/735; 215/355; 215/387

(58) Field of Classification Search
CPC ..... B65D 55/00
USPC ..... 220/361, 800, 801, 787, 203.13, 694, 220/789, 737, 738, 739, 735, 740, 703; 215/390, 387, 355; 229/403
See application file for complete search history.

(56) References Cited

U.S. PATENT DOCUMENTS

| | | | | |
|---|---|---|---|---|
| 3,126,139 | A * | 3/1964 | Schechter | 229/403 |
| RE25,618 | E * | 7/1964 | Goodman | 220/592.17 |
| 4,243,156 | A * | 1/1981 | Lobbestael | 222/541.6 |
| 5,713,512 | A * | 2/1998 | Barrett | 229/403 |
| 7,111,749 | B1 | 9/2006 | Akers | |
| 7,971,774 | B2 * | 7/2011 | Yaloz et al. | 229/401 |
| 8,490,818 | B2 | 7/2013 | Akers | |
| 2005/0230466 | A1 * | 10/2005 | Prescott | 229/403 |
| 2005/0230467 | A1 * | 10/2005 | Prescott | 229/403 |
| 2005/0284874 | A1 | 12/2005 | Lucks | |
| 2007/0023442 | A1 | 2/2007 | Auzenne | |
| 2007/0145108 | A1 * | 6/2007 | Dexel et al. | 229/403 |
| 2010/0213205 | A1 * | 8/2010 | Kang | 220/737 |

OTHER PUBLICATIONS http://cruzincap.com/shop/pc/viewcontentasp?idpage+5; CruzinCap . . . Innovative Products for the Serious Coffee Drinker; retrieved from the Internet on Feb. 3, 2014.

* cited by examiner

*Primary Examiner* — Robert J Hicks
*Assistant Examiner* — Kareen Rush

(57) ABSTRACT

Described herein is a coffee cup plug that includes a combination cup/container sleeve and plug assembly. The coffee cup plug includes a sleeve for disposable beverage containers as well as a detachable plug. The plug includes a fold line such that when the plug is detached from the sleeve and folded the folded plug is configured to be inserted into a dispensing aperture formed in the lid of the cup/container. This Abstract is submitted with the understanding that it will not be used to interpret or limit the scope and meaning of the claims.

14 Claims, 9 Drawing Sheets

COFFEE CUP PLUG

BACKGROUND

Coffee shops, juice bars, and the like typically serve beverages to customers in disposable cups. A disposable lid snaps onto a lip formed at the upper rim of the cup. The disposable lid includes an opening from which the customer drinks the beverage. However, when the customer is walking, driving, or performing other actions when he or she is not drinking, the beverage tends to spill from the opening.

BRIEF DESCRIPTION OF THE DRAWINGS

The Detailed Description references the accompanying figures. In the figures, the left-most digit(s) of a reference number identifies the figure in which the reference number first appears. The same numbers are used throughout the drawings to reference like features and components.

DETAILED DESCRIPTION

Even in this age in which coffee shops, juice bars, smoothie shops, and the like, are prevalent, it is still the case that beverages tend to spill from the openings in the lids that cover the cups in which the beverages are served. This can be troublesome especially when driving, walking or performing other actions.

Disclosed herein are techniques whereby a beverage company can offer beverages such as juice, coffee, tea, hot chocolate, milk, and other beverages to customers in disposable cups that have lids whose sipping opening can be plugged using a detachable plug located on a sleeve and/or jacket for the cup. The beverage server can prepare the beverage, pour it into the cup, and place the cup into the sleeve. The sleeve includes a portion that is detachable along a perforated perimeter. When a customer or the server removes the detachable portion, the detachable portion can be folded along a fold line to define the plug. The customer and/or server can then insert the plug into the sipping opening to reduce the chance of spillage.

Figure 1:
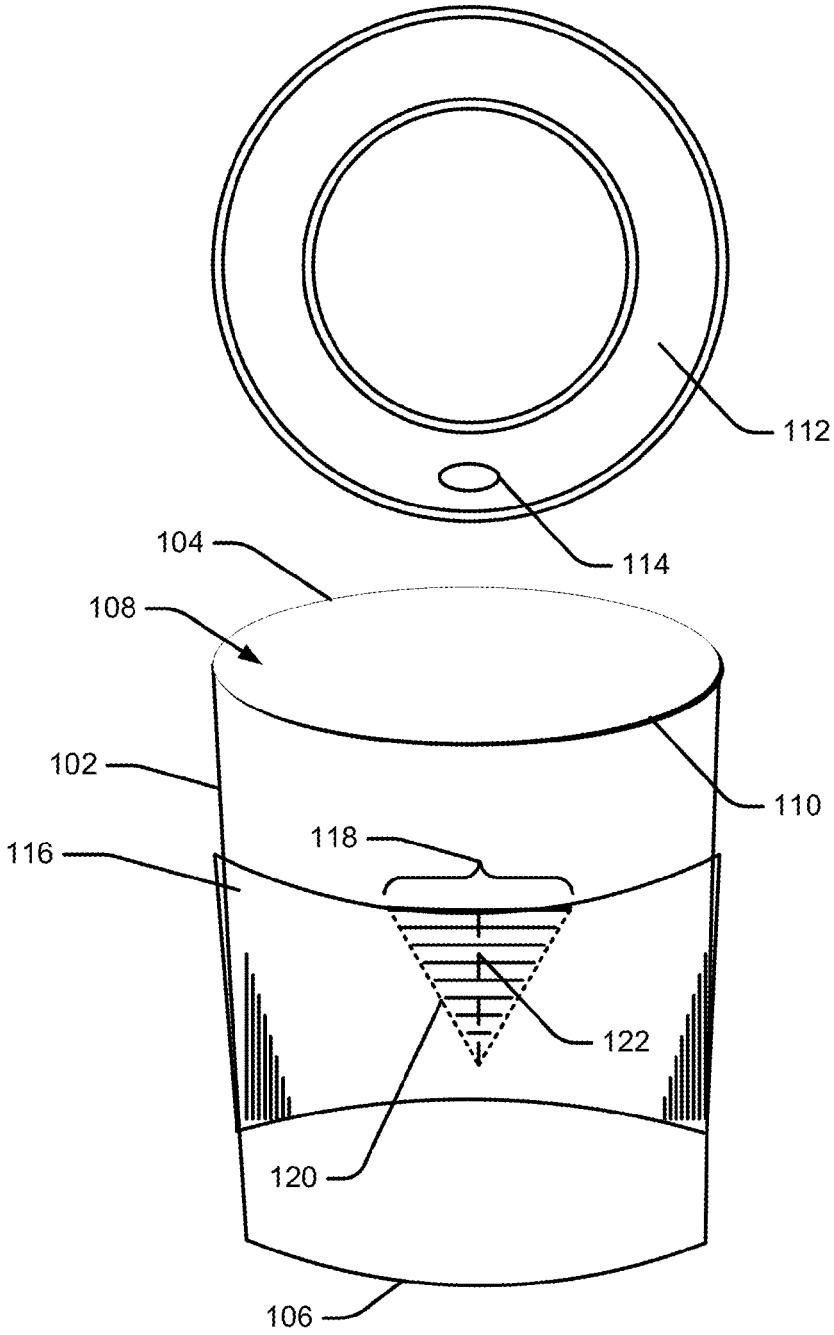
FIG. 1 shows an example beverage system in accordance with the description herein.

FIG. 1 shows an example beverage system 100 in accordance with an implementation. The illustrated system 100 includes a beverage container 102 with a body, an upper end 104, and a lower end 106. The illustrated upper end 104 of the container 102 includes an opening 108 and a rim 110. The illustrated system 100 also includes a lid 112 that mates with the rim 110 of the upper end 104 of the container 102.

The illustrated lid 112 includes a dispensing aperture 114 that dispenses a liquid. For example, a user drinks the liquid in the container 102 through the aperture 114. In one or more implementations, the liquid can be coffee, tea, juice, hot chocolate, milk, or any suitable liquid. However, the liquid may be another type of liquid such as soup, hot water, soft drinks, and the like.

The illustrated system 100 also includes a sleeve 116. In one or more implementations, the sleeve 116 encircles the container 102. In one or more implementations, the sleeve 116 includes a textured container 102-engaging surface. In one or more implementations, the textured container 102-engaging surface includes a one or more raised ribs. In one or more implementations, the sleeve 116 may be thermally insulating.

In one or more implementations, the container 102 is a disposable cup that is placed into the sleeve 116. The sleeve 116 as well as the container 102 may be made from any suitable material such as cardboard, paperboard, or the like. In implementations in which the sleeve 116 is thermally insulating, the sleeve 116 protects the user's hands from heat of the liquid in the container 102. The sleeve 116 can be manufactured using any known techniques. A suitable manufacturing technique includes the technique disclosed in U.S. Pat. No. 6,863,644.

The illustrated sleeve includes a detachable portion 118 defined by a perforated perimeter 120. The detachable portion 118 can be inserted into the dispensing aperture 114 of the lid 112. The detachable portion 118 also includes a fold line 120 along which the detachable portion 118 can be folded. The detachable portion 118 of the sleeve 116 can be manufactured using any known techniques.

When the user removes the detachable portion 118 along the perforated perimeter 120 and folds the detachable portion 118 along the fold line 122, the detachable portion forms a plug. A user can insert the plug into the dispensing aperture 114 to prevent spilling of contents of the container 102.

Figure 2:
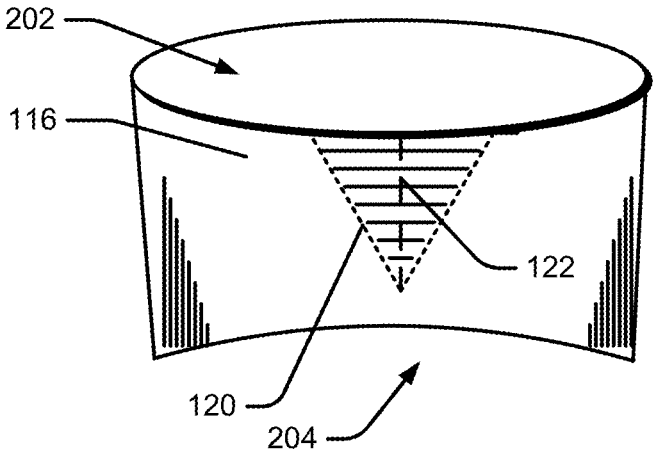
FIG. 2 shows an example of the sleeve depicted in FIG. 1 in accordance with the description herein.

FIG. 2 shows an example of the sleeve 116 in accordance with an implementation. The illustrated sleeve 116 includes an upper open end 202 and a lower open end 204. The upper open end 202 of the sleeve and the lower open end 204 of the sleeve are opposite each other.

Figure 3:
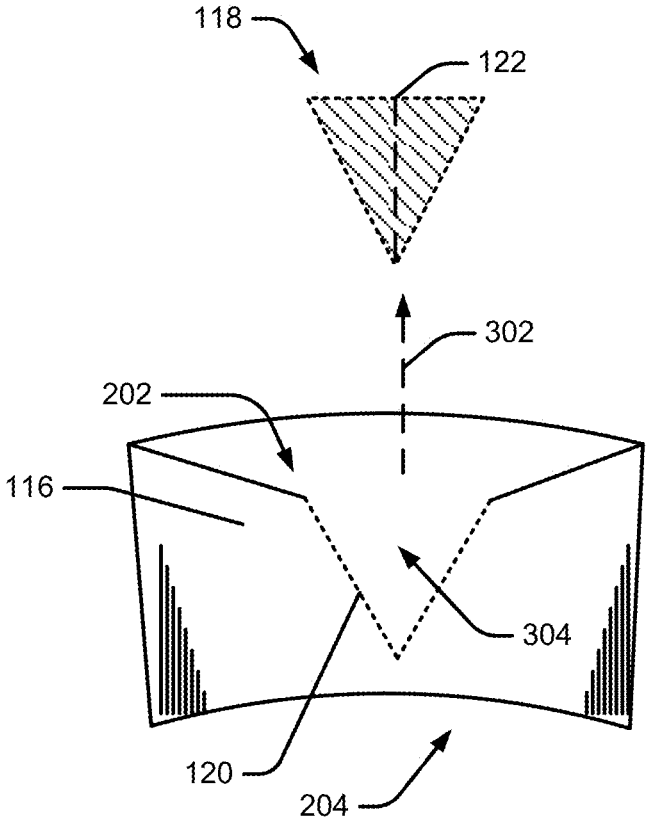
FIG. 3 shows an example sleeve with a detachable plug removed from the sleeve depicted in FIG. 3 in accordance with the description herein.

FIG. 3 shows an example sleeve 116 with a detachable plug 118 removed from the sleeve 116 in accordance with an implementation. When the detachable plug 118 is removed from the illustrated sleeve 116 along the perforation 120, the sleeve 116 includes a void 304 substantially in the shape of the detachable portion 118.

Figure 4:
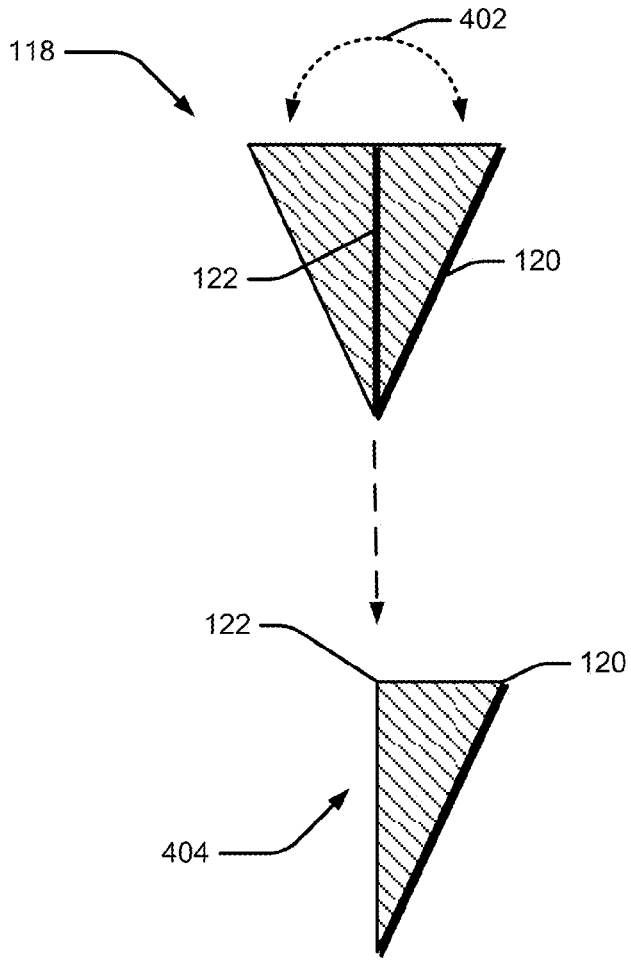
FIG. 4 shows an example of a technique to assemble the detachable plug in accordance with the description herein.

FIG. 4 shows an example of a technique to assemble the detachable portion 118 in accordance with an implementation. When the detachable portion 118 is removed from the sleeve 118 the detachable portion 118 can be folded along the fold line 122 in the direction of the arrow 402. A plug 404 is form by folding the detachable portion 118 along the fold line 122 in the direction of the arrow 402.

Figure 5:
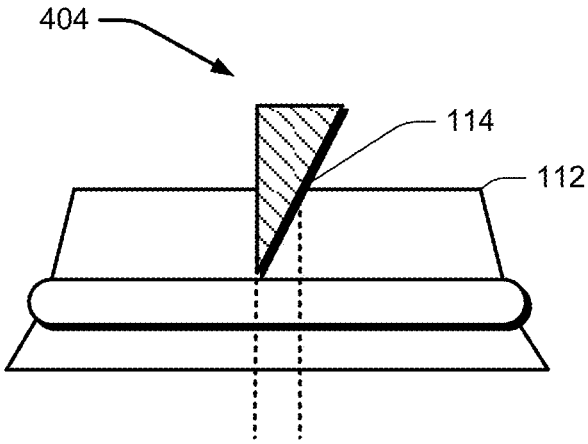
FIG. 5 shows an example technique use to insert the plug depicted in FIG. 4 in accordance with the description herein.

FIG. 5 shows an example technique use to insert the plug 404 into the aperture 114 of the lid 112 in accordance with an implementation. Note that the plug 404 fits into the opening of the aperture 114 so as to substantially prevent spilling of any liquid contents of the container 102

Figure 6:
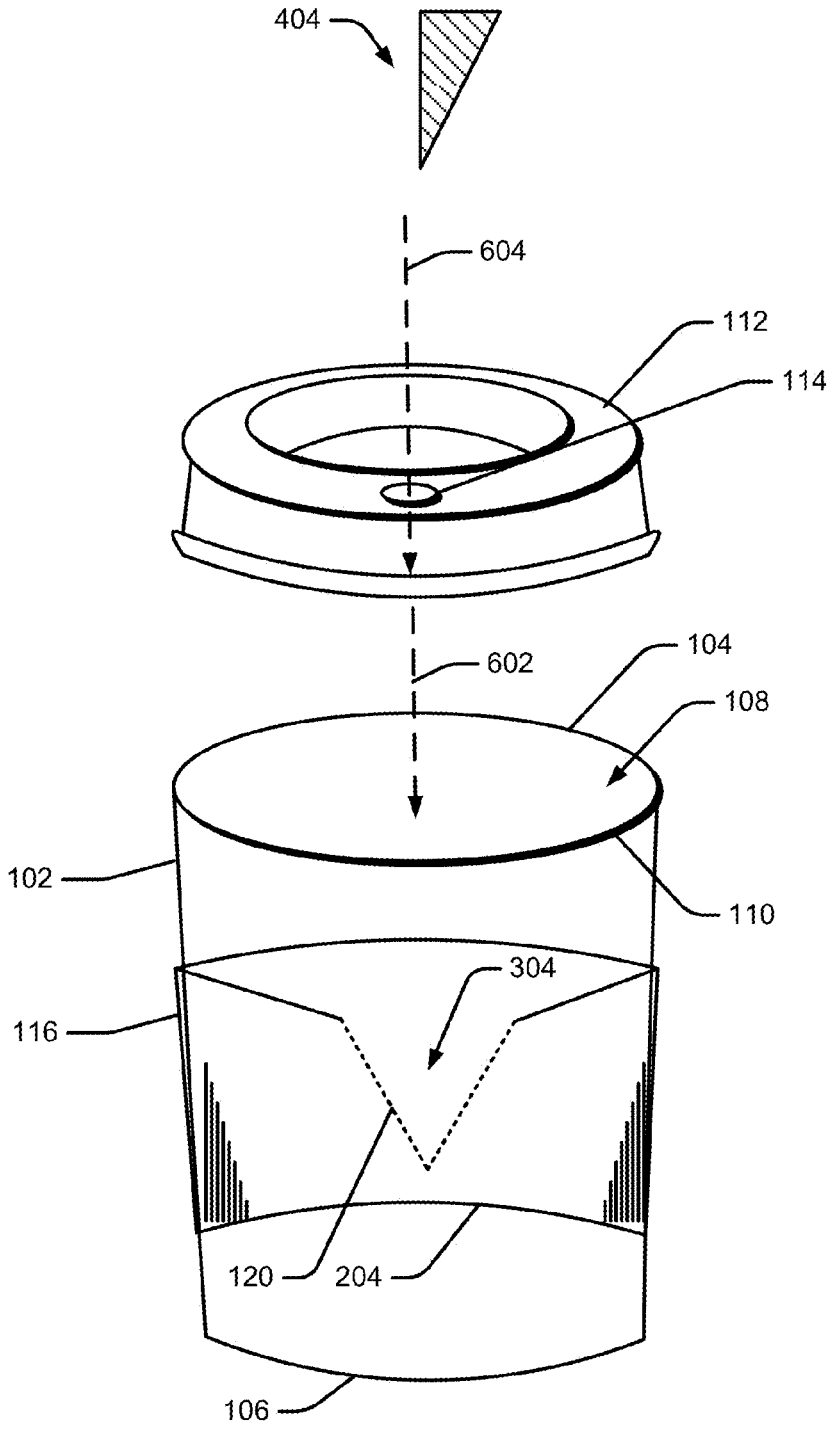
FIG. 6 shows an example of an assembly technique for the beverage system depicted in FIG. 1 in accordance with the description herein.

FIG. 6 shows an example of a technique to assemble the beverage system 100 in accordance with an implementation. The illustrated implementation shows the beverage container 102 body, the container 102 upper end 104, the container 102 lower end 106, and the container 102 opening 108 and rim 110. The illustrated system 100 also shows the lid 112 that will mate with the rim 110 along the direction of an arrow 602. The beverage container 102 body is inserted in the sleeve 116.

In the illustrated implementation, a user has removed the detachable portion 118 from the sleeve 116, leaving the void 304. The user also has folded the detachable portion 118 along the fold line 122 to form the plug 404. The user than inserts the plug 404 into the aperture 114 along the arrow 604.

Figure 7:
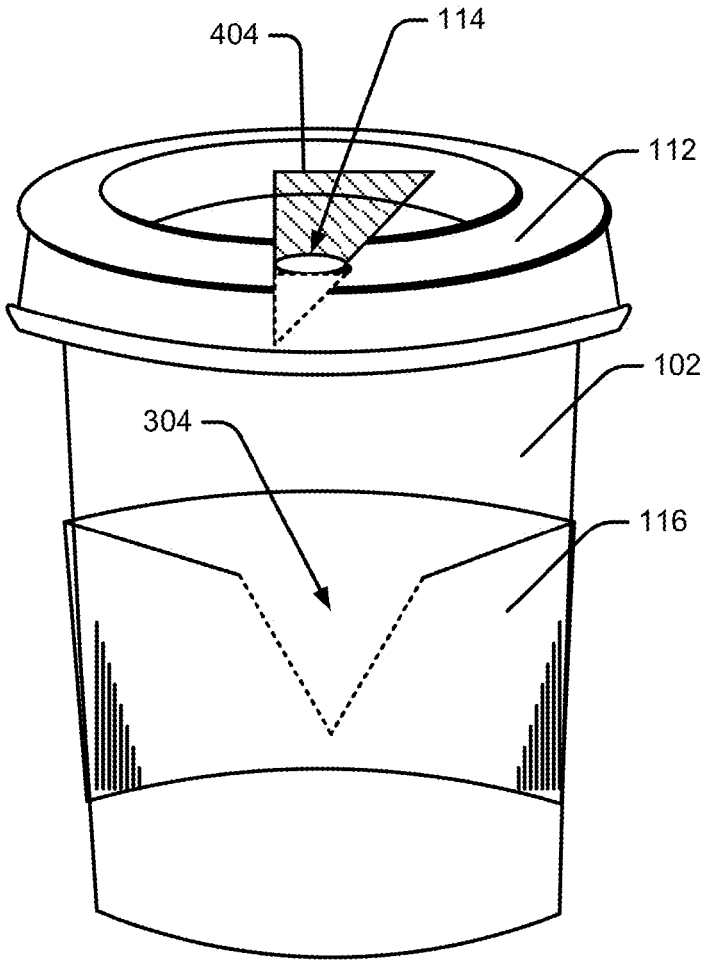
FIG. 7 shows an example of an assembled beverage system in accordance with the description herein.

FIG. 7 shows an example of an assembled beverage system 100 in accordance with an implementation. In the illustrated implementation, the lid 112 is placed on top of the container 102, which is inserted into the sleeve 116. The detachable portion 118 has been removed, forming the void 304, and folded to form the plug 404. The plug 404 has been inserted in the aperture 114 to prevent the beverage in the container 102 from spilling.

Figure 8:
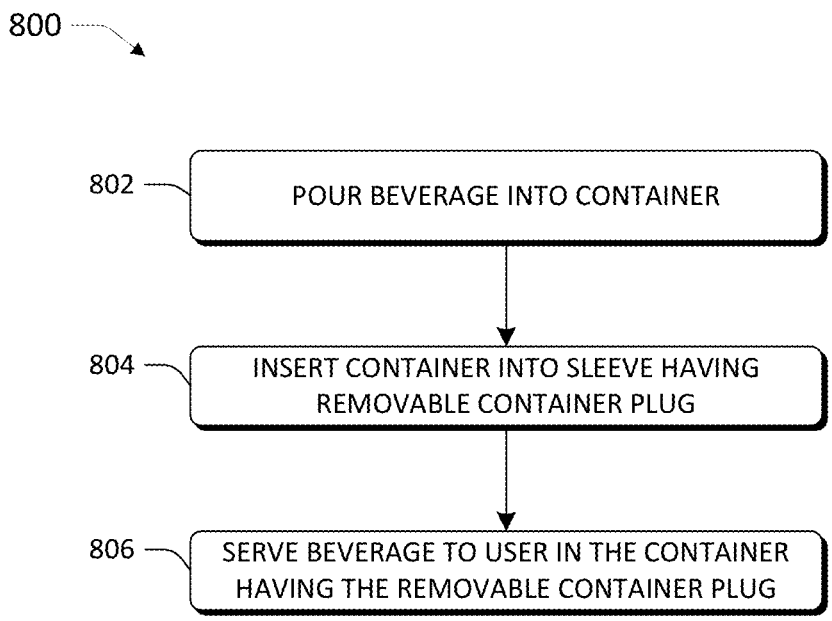
FIG. 8 is a flowchart illustrating a method for serving a beverage using the sleeve depicted in FIG. 2 in accordance with the description herein.

FIG. 8 is a flowchart illustrating a method for serving a beverage using the sleeve 116 in accordance with an implementation.

In block 802, a beverage is poured into a container. In one or more implementations, a barista, for example, pours coffee into the container 102.

In block 804, the container is inserted into a sleeve that has a detachable portion capable of being formed into a plug. In one or more implementations, the barista inserts the container 102 into the sleeve 116.

In a block 806, the beverage is served to a user in the container that has been inserted into the sleeve that has the detachable portion capable of being formed into a plug. In one or more implementations, the barista serves coffee to the user in the container 102 inserted into the sleeve 114. The user can then remove the detachable portion 118 and form it into the plug 118 to prevent spilling of the coffee.

Figure 9:
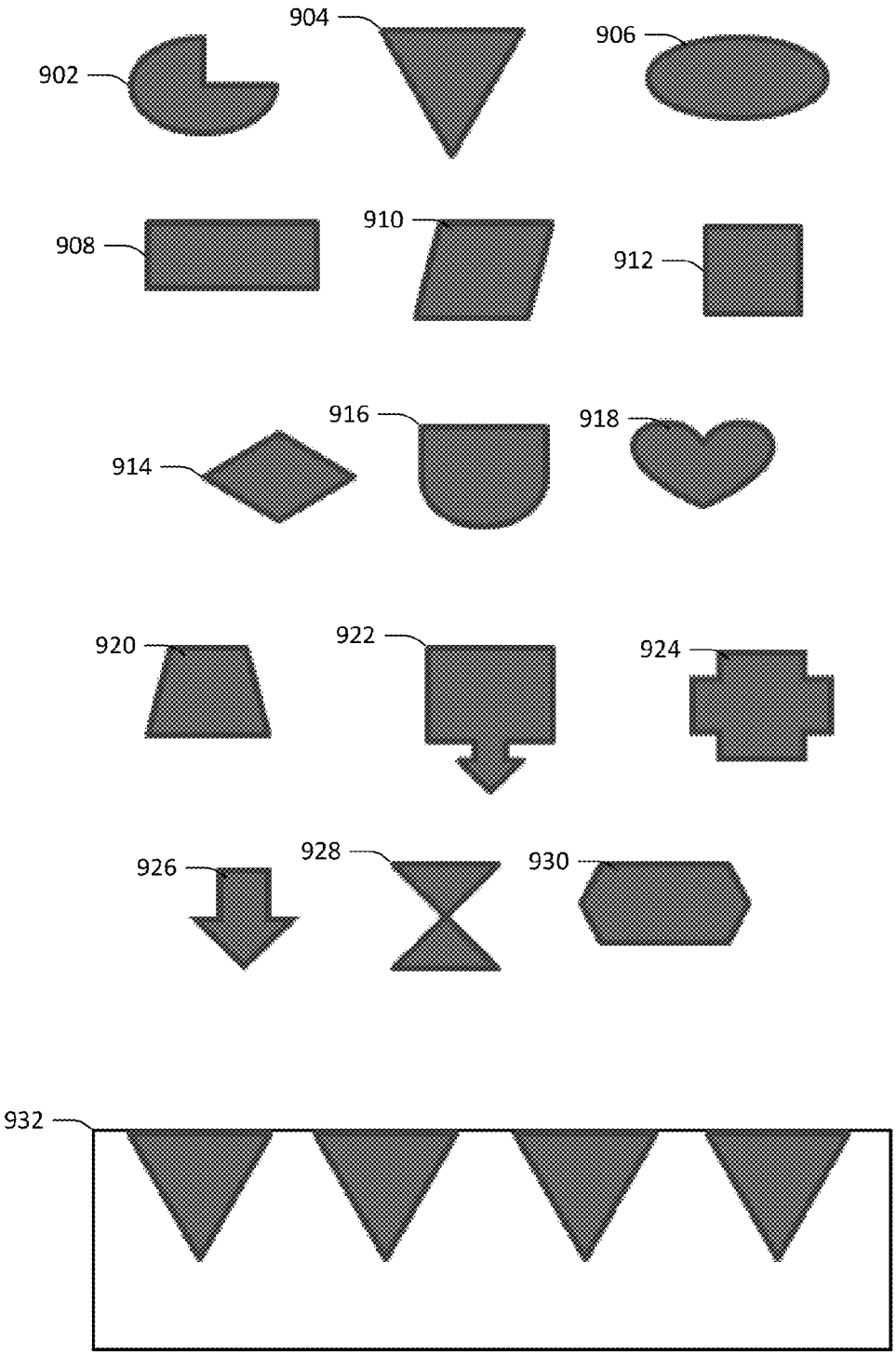
FIG. 9 shows example alternative plug shapes in accordance with the description herein.

Although various shaped have been shown with respect to an inverted "V" configuration, implementations are not so limited. For example, FIG. 9 shows example alternative plug shapes in accordance with the description herein. FIG. 9 illustrates various shapes 902, 904, 906, 908, 910, 912, 914, 916, 918, 920, 922, 924, 926, 928, 930, and 932. After reading the description herein, a person with skill in the relevant art will be able to implement the shapes illustrated in FIG. 9.

While certain features set forth herein have been described with reference to various implementations, this description is not intended to be construed in a limiting sense. Hence, various modifications of the implementations described herein, as well as other implementations, which are apparent to persons skilled in the art to which the present disclosure pertains are deemed to lie within the spirit and scope of the present disclosure.

Realizations in accordance with the present invention have been described in the context of particular embodiments. These embodiments are meant to be illustrative and not limiting. Many variations, modifications, additions, and improvements are possible. Accordingly, plural instances may be provided for components described herein as a single instance. Boundaries between various components, operations, etc., are somewhat arbitrary, and particular operations are illustrated in the context of specific illustrative configurations. Other allocations of functionality are envisioned and may fall within the scope of claims that follow. Finally, structures and functionality presented as discrete components in the various configurations may be implemented as a combined structure or component. These and other variations, modifications, additions, and improvements may fall within the scope of the invention as defined in the claims that follow.

One or more implementations are described herein with reference to illustrations for particular applications. It should be understood that the implementations are not intended to be limiting. Those skilled in the art with access to the teachings provided herein will recognize additional modifications, applications, and implementations within the scope thereof and additional fields in which the technology would be of significant utility. In the above description of example implementations, for purposes of explanation, specific numbers, materials, configurations, and other details are set forth in order to better explain implementations as claimed. However, it will be apparent to one skilled in the art that the claims may be practiced using details different from the examples described herein. In other instances, well-known features are omitted or simplified to clarify the description of the example implementations.

For example, it will be appreciated that several of the above-disclosed and other features and functions, or alternatives thereof, may be combined into many other different systems or applications. Also, it will be appreciated that various presently unforeseen or unanticipated alternatives, modifications, variations or improvements therein may be subsequently made by those skilled in the art, which are also intended to be encompassed by the claims that follow.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

What is claimed is:

1. A system comprising:

a container having a body, an upper end, and a lower end, the upper end of the container having an opening and a rim;

a lid that is configured to mate with the rim of the upper end of the container, wherein an upper open end and a lower open end, wherein the upper open end of the sleeve and the lower open end of the sleeve are opposite each other; and a detachable portion defined by a perforated perimeter, wherein the detachable portion is detachable and configured to be inserted into the dispensing aperture of the lid, wherein when the detachable portion is removed and folded a folded detachable plug is created and configured to be inserted into the dispensing aperture to substantially prevent spilling of contents of the container.

2. A system according to claim 1, wherein the detachable portion includes a fold line along which the detachable portion is configured to be folded, and wherein the detachable portion is detachable along the perforated perimeter.

3. A system according to claim 1, wherein the detachable portion includes a fold line along which the detachable portion is configured to be folded.

4. A system according to claim 1, wherein the detachable portion is detachable along the perforated perimeter.

5. A system according to claim 1, wherein when the detachable portion is removed the sleeve includes a void substantially in the shape of the detachable portion.

6. A sleeve, comprising:

an upper open end and a lower open end, wherein the upper open end of the sleeve and the lower open end of the sleeve are opposite each other; and a detachable portion defined by a perforated perimeter, wherein the detachable portion is detachable and configured to be inserted into a dispensing aperture of a lid, wherein when the detachable portion is removed and folded a folded detachable plug is created and configured to be inserted into the dispensing aperture to prevent spilling of contents from a container.

7. A sleeve according to claim 6, wherein the detachable portion includes a fold line along which the detachable portion is configured to be folded, and wherein the detachable portion is detachable along the perforated perimeter.

8. A sleeve according to claim 6, wherein the detachable portion includes a fold line along which the detachable portion is configured to be folded.

9. A sleeve according to claim 6, wherein the detachable portion is detachable along the perforated perimeter.

10. A sleeve according to claim 6, wherein when the detachable portion is removed the sleeve includes a void substantially in the shape of the detachable portion.

11. A sleeve according to claim 6, wherein the sleeve is thermally insulated.

12. A sleeve according to claim 6, wherein the sleeve is made from a paperboard material.

13. A sleeve according to claim 6, wherein the upper open end of the sleeve and the lower open end of the sleeve are located opposite each other via a textured container-engaging surface, wherein the textured container-engaging surface includes a one or more raised ribs.

14. A method for serving a beverage comprising:

pouring a beverage into a container;

inserting the container into a sleeve, wherein the sleeve includes:

an upper open end and a lower open end, wherein the upper open end of the sleeve and the lower open end of the sleeve are opposite each other; and a detachable portion defined by a perforated perimeter, wherein the detachable portion is configured to be inserted into a dispensing aperture of a container lid, wherein the detachable portion includes a fold line along which the detachable portion is configured to be folded, wherein the detachable portion is detachable along the perforated perimeter, and wherein when the detachable portion is removed and folded a folded detachable plug is created and configured to be inserted into the dispensing aperture to substantially prevent spilling of contents of the container; and serving the beverage to a user using the container that is inserted in the sleeve.

* * * * *